United States Patent [19]

Suzuki

[11] 4,370,849

[45] Feb. 1, 1983

[54] STRANDING DEVICE OF A STRANDING MACHINE

[75] Inventor: Kanji Suzuki, Tokyo, Japan

[73] Assignee: Kabushiki Kaisha Kinrei Kikai Seisakusho, Tokyo, Japan

[21] Appl. No.: 184,261

[22] Filed: Sep. 5, 1980

[30] Foreign Application Priority Data

Sep. 12, 1979 [JP] Japan ..... 54-116144

[51] Int. Cl.[3] ..... D07B 3/08; D07B 7/10; B65H 54/02

[52] U.S. Cl. ..... 57/71; 57/67; 57/99; 242/25 R

[58] Field of Search ..... 57/58.67, 58.78, 67, 57/71, 99, 92, 93, 94, 66, 66.5; 242/18 R, 25 R, 54

[56] References Cited

U.S. PATENT DOCUMENTS 4,236,373 12/1980 Bravin ..... 57/71

*Primary Examiner*—Donald Watkins

*Attorney, Agent, or Firm*—Oblon, Fisher, Spivak, McClelland & Maier

[57] ABSTRACT

A stranding machine for winding a plurality of wires on a winding drum is disclosed. In the stranding machine, a first and second sun gear are coaxially mounted on first and second shafts, with the winding drum mounted on the second shaft. Power from the driving shaft is transmitted to the first shaft and also to the second shaft via a pair of planet gears meshing with the first and second sun gears, the planet gears being mounted on a shaft fixed to a rotating disk, rotatably mounted on the second shaft. In addition, a stepless variable ratio transmission means also provides rotational motion transmission from the first shaft to the rotating disk. By varying the ratio of the stepless variable ratio transmission means, the rotating speed of the winding drum can be changed.

3 Claims, 3 Drawing Figures

STRANDING DEVICE OF A STRANDING MACHINE

BACKGROUND OF THE INVENTION

1. Field of the Invention

This invention relates to the stranding device of a stranding machine for electric wires and the like.

2. Description of the Prior Art

Conventional stranding machines have been constructed as shown in FIG. 1, in which a capstan b is driven by a driving shaft a, a flyer c is also driven by the driving shaft a, and a drum e is also driven by the driving shaft a through a stepless transmission device d. In the above prior art device, a number of fine wires f pass through the capstan b and are stranded when passing through the flyer c rotating around a winding drum e, and are wound onto the winding drum e. In FIG. 1, g is a motor, h is a transmission gear and i is an endless screw shaft for horizontal reciprocating motion of the winding drum.

In such a stranding machine as above, the winding drum is generally of a large mass, the diameter of which is sometimes larger than 600 mm, on which stranded wire is wound repeatedly, making the total weight very large. As a result, the stepless transmission gear is subject to a certain amount of inertia force when it reduces the rotational speed of the winding drum gradually in accordance with the necessity to keep the pitch of the stranded wire constant when the diameter of winding increases as the strand is wound. Therefore the stepless transmission gear itself necessarily becomes larger and more robust, so that a 2 to 4% rotating motion ratio is the limit in the case of a friction wheel, or an expensive arrangement is necessary in the case of electric or hydraulic drives, as well as the requirement of special attention for maintenance.

SUMMARY OF THE INVENTION

This invention is intended to eliminate the above weak points and has as an objective a stranding device of a stranding machine having high transmission efficiency, which changes speed accurately with little maintenance, and which makes the variable speed transmission system smaller, and consequently cheaper.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

Figures 1, 2:
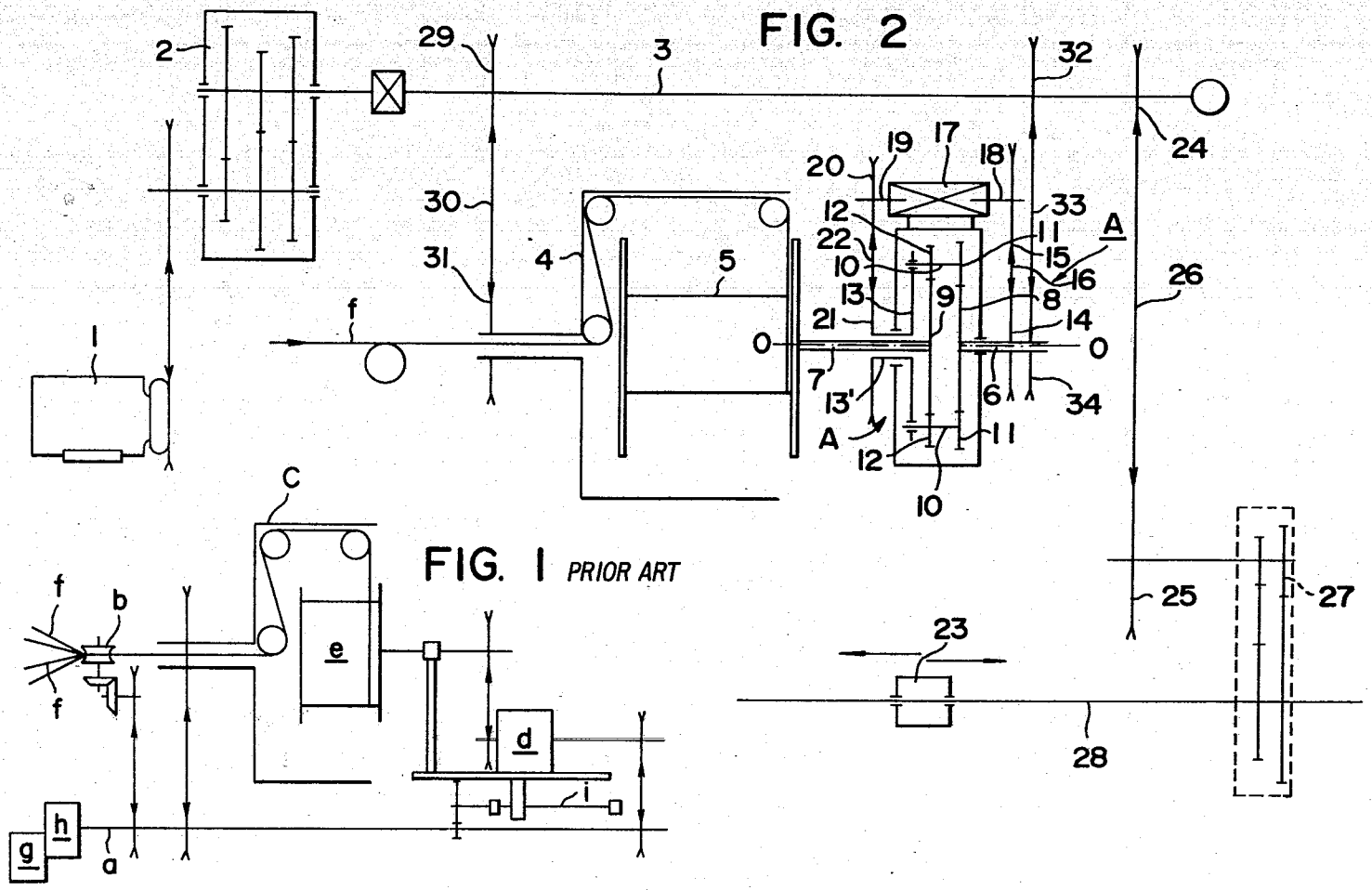
FIG. 1 PRIOR ART
FIG. 1 is a schematical drawing of a conventional stranding machine.
FIG. 2 is a stranding device of a stranding machine of this invention.

FIG. 2 shows in a stranding machine by which the revolution of the driving shaft 3 is transmitted from a prime mover 1 through a speed change gear 2 to at least the flyer 4 and the winding drum 5. The rotation of the flyer and the winding drum causes a plurality of fine wires to roll around the winding drum 5 as they are stranded by the rotating flyer 4. The concentric rotating shafts 6 and 7, which can be rotated separately about line 0—0 (see also FIG. 3), in a transmission system A, transmit the rotation of the driving shaft 3 to the winding drum 5. Rotating shaft 6, as a driver rotating shaft, is fixed to one sun gear 8 and the other sun gear 9 is fixed to the follower rotating shaft 7. Two small gears 11 and 12 are fixed to a common rotating small shaft 10 and separately mesh with sun gears 8 and 9 to operate as planetary gears. The rotating small shaft 10 to which planetary gears 11 and 12 are fixed is loosely fitted and supported on a rotating disk 13 through cylindrical journal 13'. The rotation of driving side rotating shaft 6 is transferred to an input shaft 18 of the stepless transmission gear 17 through, for instance, pulleys 14 and 15, and a belt 16. The rotation of the output shaft 19 of the transmission gear 17 is transferred to the cylindrical journal 13' on the rotating disk 13 through, for example, pulleys 20 and 21, and a belt 22.

Numeral 23 in FIG. 2 is a traverse box of the support (not shown) which supports the winding drum and the transmission system A, the movement of which the winding drum 5 shifts in a horizontal direction, and engages with a reciprocatively moving cylindrical cam shaft 28 rotated by the driving shaft 3 through, for example, pulleys 24 and 25, a belt 26 and transmission gear 27.

Numeral 29 is a pulley positioned on the driving shaft 3 and transfers rotation to a pulley 31 attached to the flyer 4, and numeral 32 is also a pulley attached to the driving shaft 3 and transmitting rotation to a pulley 34 on the driver side rotating shaft 6 through belt 33.

Because of the above structure of the preferred embodiment, a plurality of fine wires may be rolled, after being stranded by the rotation of the flyer 4, around the winding drum 5 which is rotating by the driving shaft 3 via the transmission system A. The winding drum reciprocates horizontally as it is rotating as a result of the traverse box, and has a gradually increased roll diameter due to the winding of the stranded wire.

During this period, the rotating motion for the winding drum 5 is transferred from the driving shaft 3 through pulley 32, belt 33, pulley 34, driver side rotating shaft 6, and driver side sun gear 8, and also through pulley 14, belt 16, pulley 15 and the input shaft 18 of stepless transmission gear 17.

If the stepless transmission gear 17 is operated to transfer rotation to the output shaft 19, the pulley 20, belt 22, pulley 21, the cylindrical journal 13' and the rotating disk 13, and if the driver side sun gear and the rotating disk 13 are rotated in the same direction and rotational speed, the winding drum 5 or the follower side rotating shaft 7 can be rotated in the same direction and rotational speed as the driver side rotating shaft 6. Further if the rotation of the rotating disk 13 is stopped, the rotating relation (f) will be the following:

$$\frac{\text{Speed of the driver side rotating shaft 6}}{\text{Speed of the follower side rotating shaft 7}} = \frac{\text{Teeth number of gear 11} \times \text{teeth number of gear 9}}{\text{Teeth number of gear 8} \times \text{teeth number of gear 12}} = f$$

Therefore, the rotating speed ratio f can be widely and steplessly changed by changing the speed of the rotating disk 13 so as to be faster or slower than that of the driver side rotating shaft, by use of the stepless transmission gear 17, and a constant pitch stranded wire can always be obtained if the revolution of the winding drum 5 is reduced in accordance with the increase of the winding diameter of the winding drum 5 due to the additional winding stratum.

Figure 3:
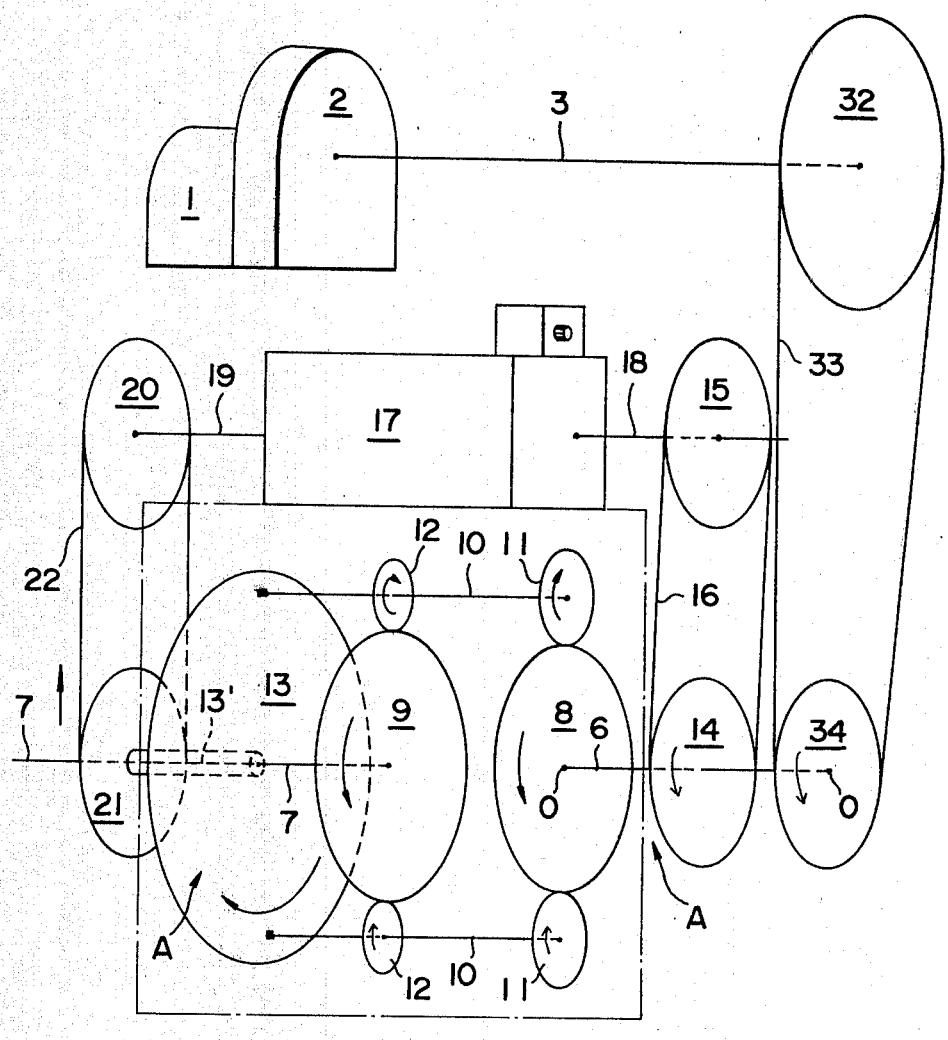
FIG. 3 is an explanatory perspective illustration of the transmission system which is a key portion of this invention.

In the planetary gear device shown in FIG. 3, making:

$N_1$ the number of revolution of the rotating shaft 6, $N_3$ the number of revolution of the rotating shaft 7, $N_2$ the number of revolution of the small shaft 10,

57 the number of teeth $Z_1$ of the sun gear 8,

25 the number of teeth $Z_2$ of the gear 11,

23 the number of teeth $Z_3$ of the gear 12,

61 the number of teeth $Z_4$ of the sun gear 9, and a the clockwise rotational speed of the rotating disk 13 (see FIG. 4);

then the following relation exists, $$\frac{N_1 - a}{N_2 - a} = -\frac{Z_2}{Z_1} \quad (1)$$

$$\frac{N_2 - a}{N_3 - a} = -\frac{Z_4}{Z_3} \quad (2)$$

multiplying both sides of the equations (1) and (2), $$\frac{N_1 - a}{N_3 - a} = \frac{Z_2 \cdot Z_4}{Z_1 \cdot Z_3}$$

therefore, $$N_3 = \frac{Z_1 \cdot Z_3}{Z_2 \cdot Z_4}(N_1 - a) + a$$

Because this invention is constructed and acts as in the above preferred embodiment, and the rotation of the driver side rotating shaft 6 is transmitted to the follower side rotating shaft 7 through spur gear train of the sun gears 8 and 9 and the planet gears 11 and 12, instead of the stepless transmission gear itself as in the case of conventional machines, the present mechanism results in making the rotation transmitting device quite simple, and the transmission efficiency is quite high as the rotation is transmitted through a spur gear train, without the disadvantages of rotation reduction as accompanies a stepless transmission gear, by which at least 2 to 4 percent reduction occurs even with relatively high efficiency, and the stepless transmission gear is used only for the adjustment of the orbiting speed of the said planet gears 11 and 12. Therefore the drum can be made smaller because no large power is applied, and the rotation drop rate of this stepless transmission gear, if it occurs, effects only the orbiting speed of the planetary gear, gives only very small effect to the rotation of winding drum 5, allowing more accurate revolution control of the winding drum compared with conventional equipment, and can be produced at lower cost so that quite an effective result is obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A stranding machine for winding a plurality of wires on a winding drum, comprising:

a driving shaft;

a flier for said winding drum;

a first and a second sun gear, said first sun gear mounted on a first shaft driven by said drive shaft, said second sun gear mounted coaxially with first sun gear on a second shaft fixed to said winding drum;

at least one set of first and second planet gears each said at least one set being coaxially mounted on a third shaft and respectively meshing with said first and second sun gears;

a rotating disk rotatably mounted on said second shaft coaxially with said sun gears, each said third shaft being mounted on said rotating disk;

stepless variable ratio transmission means; and means for transmitting rotational motion from said first shaft to said transmission means and from said transmission means to said rotating disk;

whereby the rotating speed ratio of said winding drum can be changed by varying said transmission means.

2. The machine of claim 1 including means for directly transmitting rotational motion from said drive shaft to said flier.

3. The machine of claim 1 including means for reciprocating at least said winding drum along the axis of said second shaft.

* * * * *